US005699570A

United States Patent [19]

Wilkinson et al.

[11] Patent Number: 5,699,570

[45] Date of Patent: Dec. 23, 1997

[54] PRESSURE RELIEF VALVE VENT LINE MATTRESS SYSTEM AND METHOD

[75] Inventors: John W. Wilkinson, Bennington, Vt.; Richard W. Raburn, Simpsonville, S.C.

[73] Assignee: Span-America Medical Systems, Inc., Greenville, S.C.

[21] Appl. No.: 665,056

[22] Filed: Jun. 14, 1996

[51] Int. Cl.[6] ..... A61G 7/04; A47C 27/10

[52] U.S. Cl. ..... 5/713; 5/714; 5/739; 5/914

[58] Field of Search ..... 5/706, 710, 711, 5/712, 713, 714, 735, 740, 914

[56] References Cited

U.S. PATENT DOCUMENTS

| | | | |
|---|---|---|---|
| 4,803,744 | 2/1989 | Poch et al. | 5/713 |
| 4,825,486 | 5/1989 | Kimura et al. | 5/713 |
| 4,993,920 | 2/1991 | Harkleroad et al. | 5/713 X |
| 5,373,595 | 12/1994 | Johnson et al. | 5/713 X |
| 5,412,821 | 5/1995 | Wilkinson | 5/713 X |
| 5,509,155 | 4/1996 | Zigaree et al. | 5/714 X |
| 5,539,942 | 7/1996 | Melon | 5/655.3 |

*Primary Examiner*—Michael F. Trettel
*Attorney, Agent, or Firm*—Dority & Manning, PA

[57] ABSTRACT

A pressure relief valve vent line mattress system utilizes a self-adjusting approach with a single air source to obtain in combination a low air loss feature for beneficial cooling and drying of a patient's skin. A single air supply source outputs a predetermined positive flow of air into one or more patient air support bladders. An air distribution manifold received within a mattress body receives and disperses overflow pressure routed thereto from the patient air support bladders via an air passageway having a first pressure relief valve with an established set point. A second pressure relief valve is associated with a pump return line adjunct to the constant air flow pump. The net effect is to disperse overflow pressure from the mattress bladders (tending to keep such bladders at a constant pressure) while providing low air loss through the mattress for patient cooling and drying effects, all utilizing a single air flow source.

26 Claims, 4 Drawing Sheets

PRESSURE RELIEF VALVE VENT LINE MATTRESS SYSTEM AND METHOD

BACKGROUND OF THE INVENTION

This invention generally relates to the field of pressure relief and more particularly to self-adjusting pressure relief systems with combined low air loss features and to corresponding methodologies.

Particularly in the field of health care, there has been a long felt need to provide pressure relief for immobile or confined patients. Many patients must withstand long periods of bed rest or other forms of confinement, such as use of a wheelchair. In those instances, there is a tremendous risk that exposures to excess pressures, or longer term exposures to relatively lower pressure levels, can result in painful and even dangerous sores and other conditions.

Literally an entire segment of the health care industry is directed to the study and treatment of various tissue traumas, such as decubitus ulcers. Excess or trapped heat and/or moisture can also contribute significantly to tissue care and management problems. Tissue damage can be monitored and rated, with progressively higher ratings warranting more involved treatment approaches. Consequently, the health care industry perceives and evaluates treatment options on the basis of their ability to address conditions at such different stages or ratings.

Some patient conditions to be addressed are not initially caused by excess pressure damage. For example, burn patients often have critical and even life threatening tissue care needs, but which did not originate from an excess pressure condition. Again, the initial condition of the patient is also ratable, which tends to dictate the measure of response.

Still further patients or others may have special needs, for example, due to injuries such as hip fractures or the like. Other patients may have more long term specialized needs, such as amputees, who may have pressure sensitive areas and pressure points not accounted for by a support arrangement designed for a patient having weight dispersed over all limbs.

Numerous products, based on various technologies, have sought to address the constantly ongoing problems referenced above. As higher rated problems are addressed with technically more difficult solutions, the costs of available treatments tend to rise in proportion with the rated magnitude of the problem.

Generally speaking, while cost containment has always been of concern in the health care industry, it has recently become a much more significant issue. As a net result of various forces acting with a goal of reducing costs, it is possible that the treatment needs (whether preventative or curative) of specific patients may run the risk of being inappropriately or even inadequately addressed.

Over time, as in any sort of industry, efforts have been made to simultaneously improve both quality (in the sense of product performance) and price. Typically, it can be difficult to simultaneously achieve both such goals, especially whenever product performance improvement conventionally comes at the expense of more entailed and sophisticated technologies. In addition, it is frequently the case that achieving top performance (i.e., optimized pressure relief or dispersion or tissue care) is highly challenging, regardless of the available technology, at any cost. One contributing factor is the tremendous variation in individual patient needs which must be potentially met by a particular product (i.e., support system or methodology).

Typically, various support systems have made use of resilient support bodies, such as strips or blocks of foam, or have made use of some other element, such as a support bladder containing a specific fluid. Mattress technologies, in general, have often made use of other resilient support media, such as springs, slats, or various support fillers, such as ticking. Different gases, often such as air, or various liquids have been used, including relatively viscous liquids, such as gels. In some instances, combinations of the above various technologies have been used.

As an effort to provide various cost effective designs applicable in different circumstances, there has generally been a progression in the sophistication of various products. For example, a repeating pattern such as convolutions may be readily formed in a resilient foam product for providing a resilient mattress supplement. See, for example, U.S. Pat. No. 4,686,725 entitled "Mattress Cushion with Securement Feature." While various repeating surface patterns are readily produced, more complicated repeating surface patterns have been provided in efforts to improve product performance over convoluted pads. See, for example, U.S. Pat. No. 4,901,387 entitled "Mattress Overlay with Individual Foam Springs."

One aspect of support systems, especially concerning those for use with recumbent patients, is that they are faced with distinctly different loading requirements over the patient (longitudinally and transversely). In other words, certain body areas of a patient will be heavier than others, thereby generally requiring greater support in such areas if pressure relief is to be optimized.

As a result, various support pads have sought to provide sectionalized support. One such resilient foam pad making use of a uniform patterned surface, though with differential resilient support responsive to different loads, is U.S. Pat. No. 5,007,124 entitled "Support Pad with Uniform Patterned Surface."

As foam surface patterns become more sophisticated, there is typically a corresponding increase in the difficulty of producing such articles. One example of a three section foam mattress is U.S. Design Pat. No. D336,400, entitled "Foam Mattress Pad." Another example of a still more complicated foam mattress surface, typically utilizing a computer controlled cutting machine for production, is U.S. Pat. No. 4,862,538, entitled "Multi-Section Mattress Overlay for Systemized Pressure Dispersion."

Still further examples of various resilient foam support pads and the like, and certain aspects of manufacture thereof, are shown by U.S. Pat. No. 4,603,445; U.S. Pat. No. 4,700,447; U.S. Design Pat. No. D307,688; U.S. Design Pat. No. D307,689; U.S. Design Pat. No. D307,690; U.S. Pat. No. 5,025,519; U.S. Design Pat. No. D322,907; and U.S. Pat. No. 5,252,278.

Generally speaking, on the one hand, as support surface designs become more entailed, they become more difficult and more expensive to produce. At the same time, regardless of the manufacturing cost, they tend to provide a generally static or preset response profile to loading changes, i.e., changes in the weight of the patient being supported in a specific region of the pad. Such variations may occur due to the variations among patients, or simply due to the movement of an individual patient.

Other technologies involving fluid filled support bladders of various sorts may be incorporated into different types of systems regarded as either static or dynamic. Typically, what is meant by a static system is that the fluid level within a particular support chamber is sealed or otherwise relatively unchanged. One relatively dynamic aspect might involve a fluid chamber constantly replenished against fluid losses. The pressure dispersion offered with a static system is thus, in at least one sense, analogous to the preestablished response expected with fixed resilient foam systems. However, it will be apparent to those of ordinary skill in the art that a fluid filled chamber approach, even in a static condition, would provide hydraulic fluid flow performance not found in a resilient foam system. Of course, the net pressure relief performance of any system or methodology encompasses various factors.

One example of a pressure relief support system utilizing fluid filled chambers is shown by U.S. Pat. No. 5,070,560, entitled "Pressure Relief Support System for a Mattress." In such patent, sealed longitudinal air cylinders are provided in the shape of a mattress, otherwise having various transverse slats and/or foam strips or members. Such a support system offers a form of air pressure equalization in a static design which avoids the relative extremely high cost and other negative factors often associated with active air bed systems.

Highest rated pressure relief support systems typically involve beds having a plurality of fluid filled chambers, the internal pressures of which are maintained at a constant pressure by a relatively higher technology dynamic system approach. Specifically, each fluid filled support element may be associated with its own controllable valve, alternately permitting ingress and egress of fluid with intentional active control. Various pressure sensitive detection devices typically may be utilized in a feedback control system for determining that an excess pressure condition (or a subpressure condition) exists. Thereafter, the control technology is operative for bleeding off excess pressure by selected valving operation (such as dumping excess fluid into a reservoir arrangement) or for actively pumping in additionally needed fluid.

As such, the above higher technology systems require various motors, pumps, valving systems, sensory feedback arrangements, and control systems for all the foregoing, all in operative combination. Due to their complicated, detailed construction and design, such beds are typically very expensive as to initial purchase or rental cost. They can also be complicated and expensive to maintain due to the prospect of frequent failure of numerous moving mechanical parts, and due to the extensive training which an operator or maintenance person would be required to undergo.

Also, there is the prospect of highly undesired heat transfer to a patient, due to operation of the above-referenced motors, pumps and other systems. Still further, the construction and design of such overall systems often require specialized bed frames not otherwise usable with typical mattresses.

The disclosures of the above-referenced United States Patents are fully incorporated herein by reference, all of which such Patents are commonly owned with the subject application.

SUMMARY OF THE INVENTION

The present invention is intended to recognize and address various of the foregoing problems, and others, concerning pressure relief systems and methodologies. Thus, broadly speaking, a principal object of this invention is improved pressure relief methodologies and systems. More particularly, a main concern is improved self-adjusting technology without requiring the expense and complexity of typical higher technology prior systems.

It is, therefore, another particular object of the present invention to provide apparatus and methodology which achieves the performance advantages of a dynamic fluid-based system, but at the same time without requiring the complicated and expensive constructions and designs typical of previous systems.

It is another general object of the present invention to provide a self-adjusting system which is capable of simultaneously providing improved tissue management, namely cooling and drying effects for alleviating temperature and moisture build-up problems, respectively.

A more particular object is to provide such an improved system and methodology which does not require the use of active feedback or more than one air flow source. More specifically, it is a present object to avoid the need for sensory feedback control systems, and/or systems for actively controlling pump and valving systems, but while also still providing a relatively dynamic fluid-based system.

Another present general object is to provide a fully self-adjusting pressure relief system which optimizes pressure dispersion, while still using a relatively inexpensive and simple design so as to obviate the need for motors combined with active control systems (or with active sensory feedback loops), or specialized bed frames or training associated with its use and maintenance. A general object is to provide an automatic pressure control operation or feature combined with a low air loss feature, for improved total skin care treatment, while utilizing a single air supply source in such combined features arrangement, for greatest cost efficiency.

Yet another object is to provide a pressure relief support system which is self-adjusting to allow for more even body weight distribution, thereby improving the reduction of pressure on the tissue and skin of a user. At the same time, it is an object to provide a self-adjusting technology which may be customized, as desired, for different patient uses, and for different alternative uses.

It is intended to provide improved self-adjusting technology usable in both medical and commercial fields, including both mattress-related technologies and seating technologies, as well as others. In the area of medical uses, it is intended to provide a system and improved technology which is usable in space critical circumstances, such as involving X-ray, operating room, or NMR technology uses. It is intended for the present technology to be equally applicable to critical care situations, emergency room gurneys, ambulance stretchers and medical seating systems of all types, such as wheelchairs or geriatric chairs.

It is another present object to provide a self-adjusting technology with the advantages of active (i.e., dynamic) fluid-based systems, but with such simplicity that the technology may be extended to every day consumer products, such as ergonomic chairs and car seats, as well as consumer mattress replacement systems, mattresses and mattress overlays (as would also be applicable in the medical field).

Still another present object is to provide improved methodologies corresponding in scope with practice of the subject systems and devices in accordance with this invention.

Additional objects and advantages of the invention are set forth in or will be apparent to those of ordinary skill in the art from the detailed description which follows. Also, it should be further appreciated that modifications and variations to the specifically illustrated and discussed features, steps or materials hereof may be practiced in various embodiments and uses of this invention without departing from the spirit and scope thereof, by virtue of present reference thereto. Such variations may include, but are not limited to, substitution of equivalent means and features, materials or steps for those shown or discussed, and the functional or positional reversal of various parts, features, steps, or the like.

Still further, it is to be understood that different embodiments, as well as different presently preferred embodiments, of this invention may include various combinations or configurations of presently disclosed features, steps, or elements, or their equivalents (including combinations of features or steps or configurations thereof not expressly shown in the figures or stated in the detailed description). Also, it is to be understood that various features from one embodiment, as illustrated, discussed or suggested, may be combined with or substituted for features of other disclosed or suggested embodiments, within the spirit and scope of the present invention.

One exemplary embodiment of the present invention relates to a pressure relief valve vent line mattress system. Such system may preferably comprise a mattress body including at least one patient air support bladder having a bladder air input port; an air supply pump means, with a pump air supply output port, for outputting a predetermined positive flow of air at the pump air supply output port thereof; and a first air tube interconnecting such pump air supply output port with the bladder air input port so that the predetermined positive flow of air is supplied to the patient air support bladder.

Such an exemplary mattress system embodiment may preferably further include at least one air distribution manifold received within such mattress body and having a manifold air input port for receiving and dispersing air supplied thereto; a second air tube interconnecting with the first air tube in parallel therewith and interconnecting with the manifold air input port; and a first pressure relief valve operatively received in the second air tube, and having a set point established such that overflow pressure from the patient air support bladder is dispersed within said mattress body as low air loss via the manifold. Such an arrangement beneficially provides for patient cooling and drying effects while the pressure level within the patient air support bladder is automatically controlled by venting via the manifold such bladder overflow pressure.

The foregoing exemplary mattress system may be equally practiced in the form of corresponding methodology, as further described in this application.

Another present exemplary embodiment concerns a self-adjusting pressure relief patient support apparatus with low air loss function, comprising a main support body, constant air flow pump means, and overflow pressure manifold means.

In such an exemplary embodiment, preferably the main support body is provided for receiving a patient thereon, and having at least one adjustable air support bladder with air therein. The constant air flow pump means is situated in pneumatic communication with the air support bladder, for automatically supplying the bladder a generally constant predetermined air flow regardless of changing patient loading on said main support body. The overflow pressure manifold means, operatively associated with the air support bladder, is operative for dispersing overflow pressure air therefrom through the main support body as a low air loss, so that bladder air pressure is automatically controlled as patient cooling and drying effects are provided with the low air loss derived from such overflow pressure.

Yet another construction comprising a presently exemplary embodiment concerns an air bladder mattress system providing automatic air pressure equalization combined with low air loss function achieved from a single air flow source, such system comprising: a main patient support mattress having respective foam and air bladder support elements, including a plurality of air bladders each of which have respective bladder air input ports; an air flow pump having a generally constant air flow output; a first section of air tubing directing the pump air flow output commonly into the respective bladder air input ports; at least one bleeder tube residing within the main patient support mattress, and having a plurality of low air loss holes formed therealong so that air fed to one end of such bleeder tube is dispersed within the mattress via the tube holes; and a second section of air tubing and a pressure relief valve with a predetermined set point, collectively forming a vent line between the first section of air tubing and the bleeder tube.

With the foregoing exemplary arrangement, air pressure within the plurality of air bladders greater than that of the predetermined set point of the pressure relief valve is dispersed via the low air loss holes so as to automatically control such bladder air pressure while providing patient cooling and drying effects, thereby utilizing the air flow pump as a single source of air flow for operating both such functions.

It is to be understood that the subject invention also relates to and encompasses corresponding methodologies, also as discussed herein. Those of ordinary skill in the art will better appreciate the features and aspects of such embodiments, methods and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
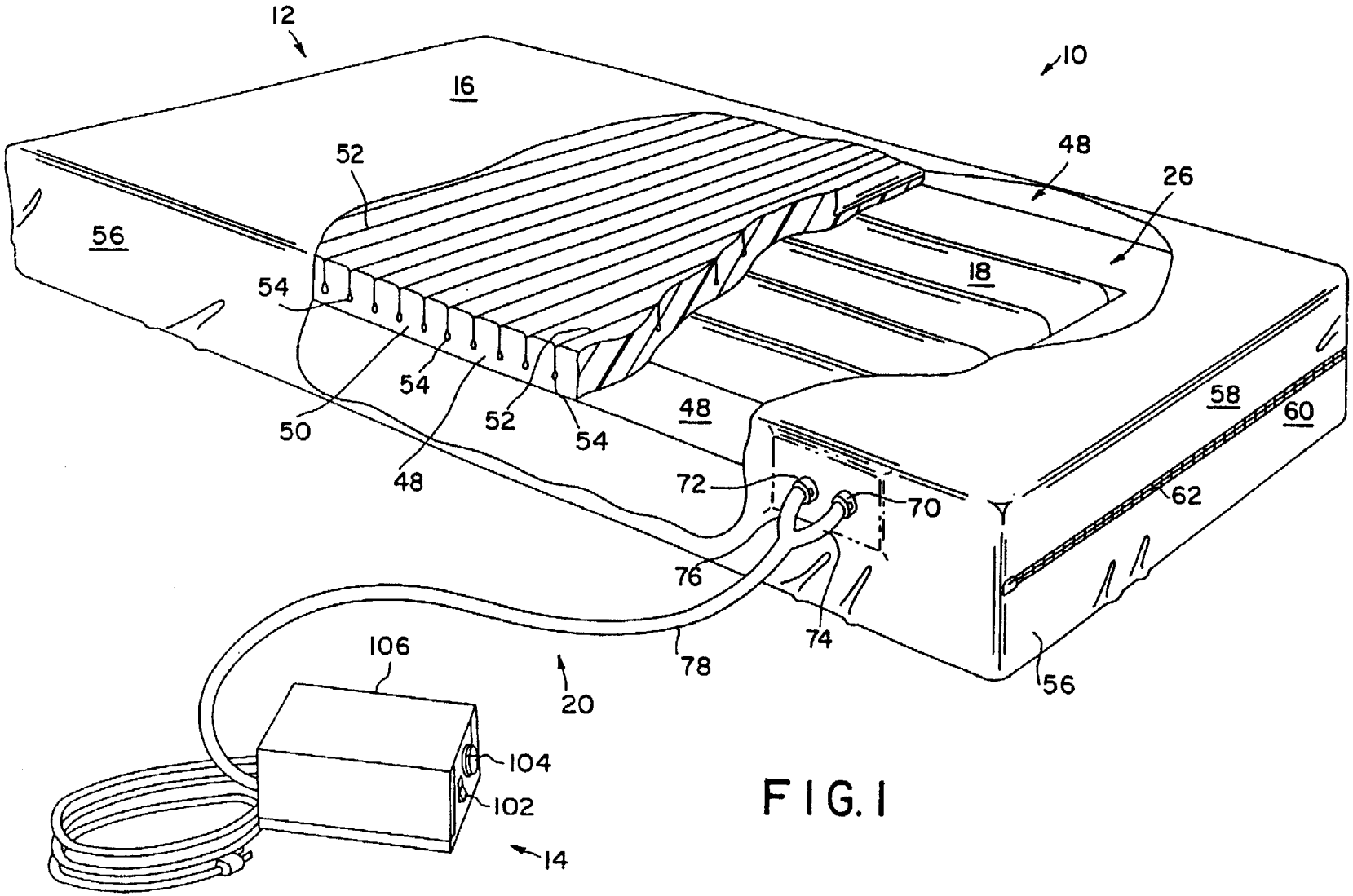
FIG. 1 is a generally top and side perspective view, in partial cutaway, of a first embodiment of a mattress system in accordance with the subject invention.

Repeat use of reference characters throughout the present specification and appended drawings is intended to represent same or analogous features, elements, or steps of the invention.

DETAILED DESCRIPTION OF THE PREFERRED EMBODIMENTS

It will be readily understood by those of ordinary skill in the art that the following discussion relates to specifics solely for the purpose of explaining exemplary embodiments of the present invention, and that all such description is not intended as limiting the otherwise more broadly stated aspects hereof.

FIG. 1 shows a generally top and side perspective view, with partial cutaway, of a first embodiment of a pressure relief valve vent line mattress system generally 10 in accordance with the subject invention. The represented mattress system 10 preferably includes a combination of several primary components, including a main support body generally 12, a constant air flow pump means generally 14, and overflow pressure manifold means (not visible in FIG. 1). Such a main support body 12 is provided for receiving a patient thereon, such as on an upper surface 16. At least one adjustable air support bladder with air, such as bladder 18, is provided.

Generally speaking, constant air flow pump means 14 is in pneumatic communication with such air support bladder 18 by way of interconnecting air tubing generally 20. Such pump means 14 is functional for automatically supplying bladder 18 with a generally constant predetermined air flow, regardless of changing patient loading on upper surface 16 of the main support body generally 12.

The overflow pressure manifold means (not visible in FIG. 1) functions in such an embodiment by operative association with air support bladder 18 for dispersing overflow pressure air from such bladder 18 through main support body 12. Such dispersion is in the form of a low air loss throughout body 12. With such approach, bladder air pressure is automatically controlled as patient cooling and drying effects are provided with the low air loss derived from such overflow pressure.

Figure 2:
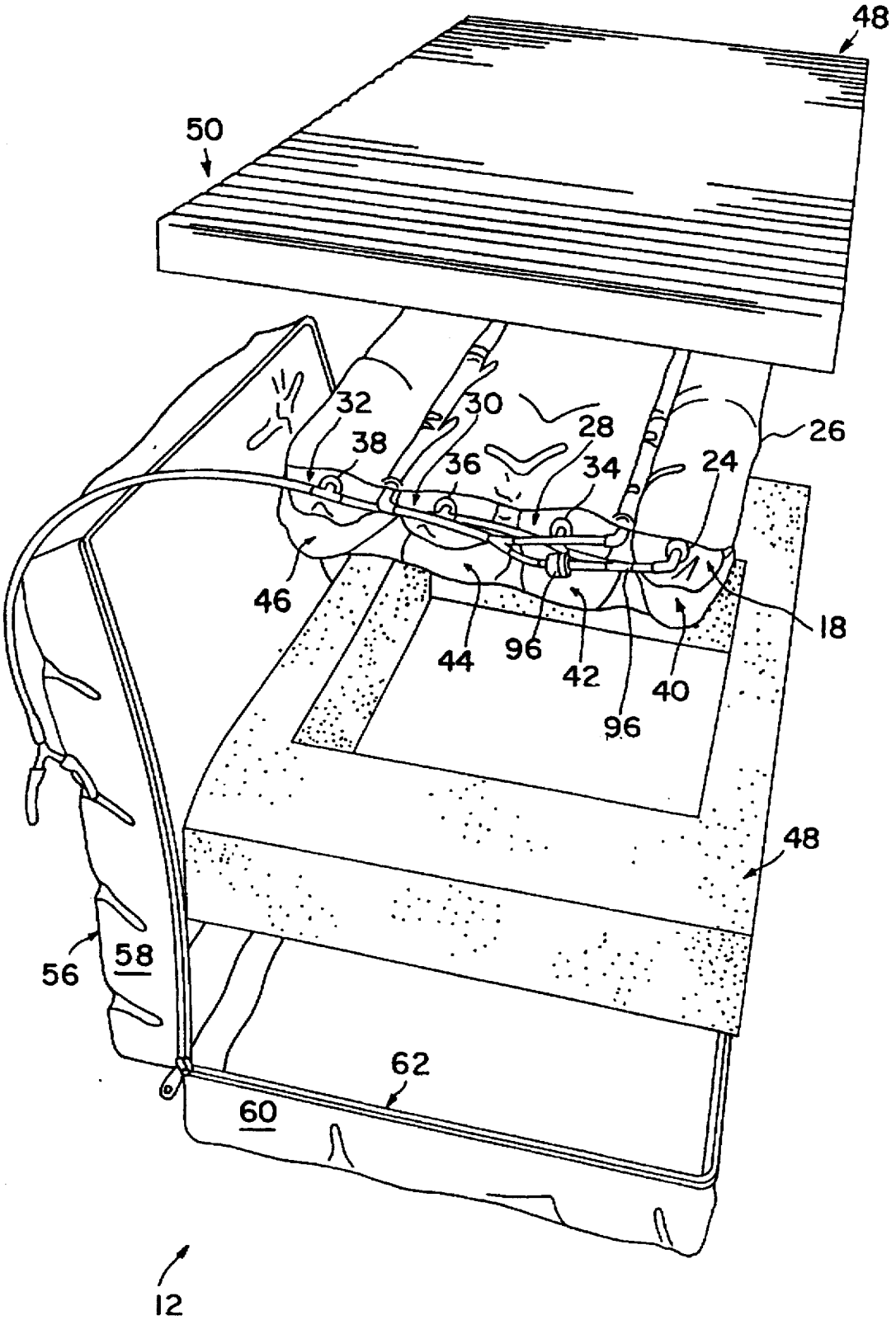
FIG. 2 is a generally top and end perspective view (in exploded position) of the exemplary first embodiment in accordance with the subject invention.
Figure 3:
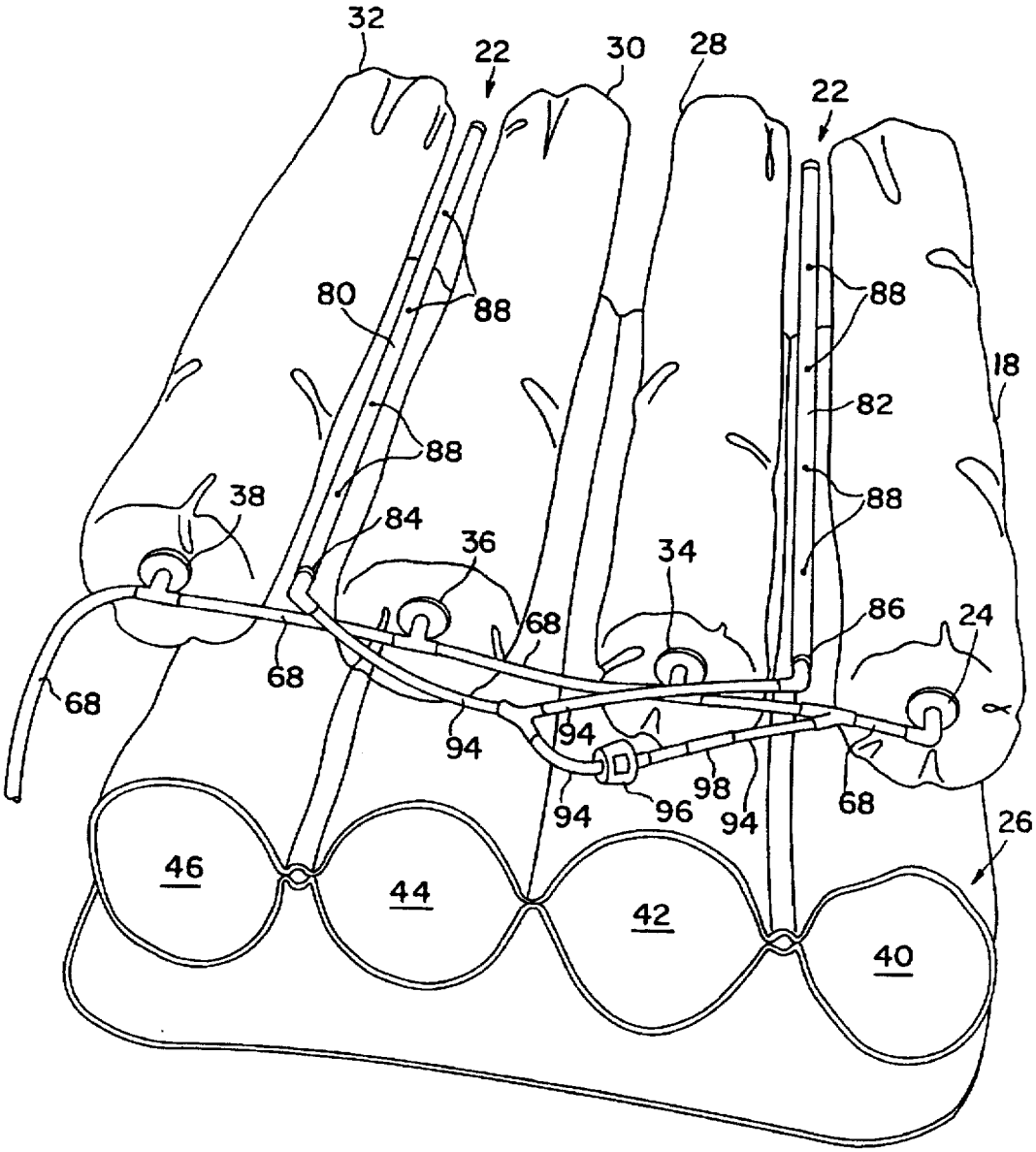
FIG. 3 is an enlarged generally isolated view, showing the top and end perspective of particular features of the present exemplary embodiment.

FIG. 2 represents a generally top and end perspective view, in exploded condition, of the exemplary main support body generally 12 of present FIG. 1. FIG. 3 shows an enlarged view, in isolation, of air bladder and air tubing related aspects of the exemplary embodiment of present FIGS. 1 and 2. FIG. 3 also illustrates and represents exemplary overflow pressure manifold means, generally 22, in accordance with the subject invention.

Figure 4:
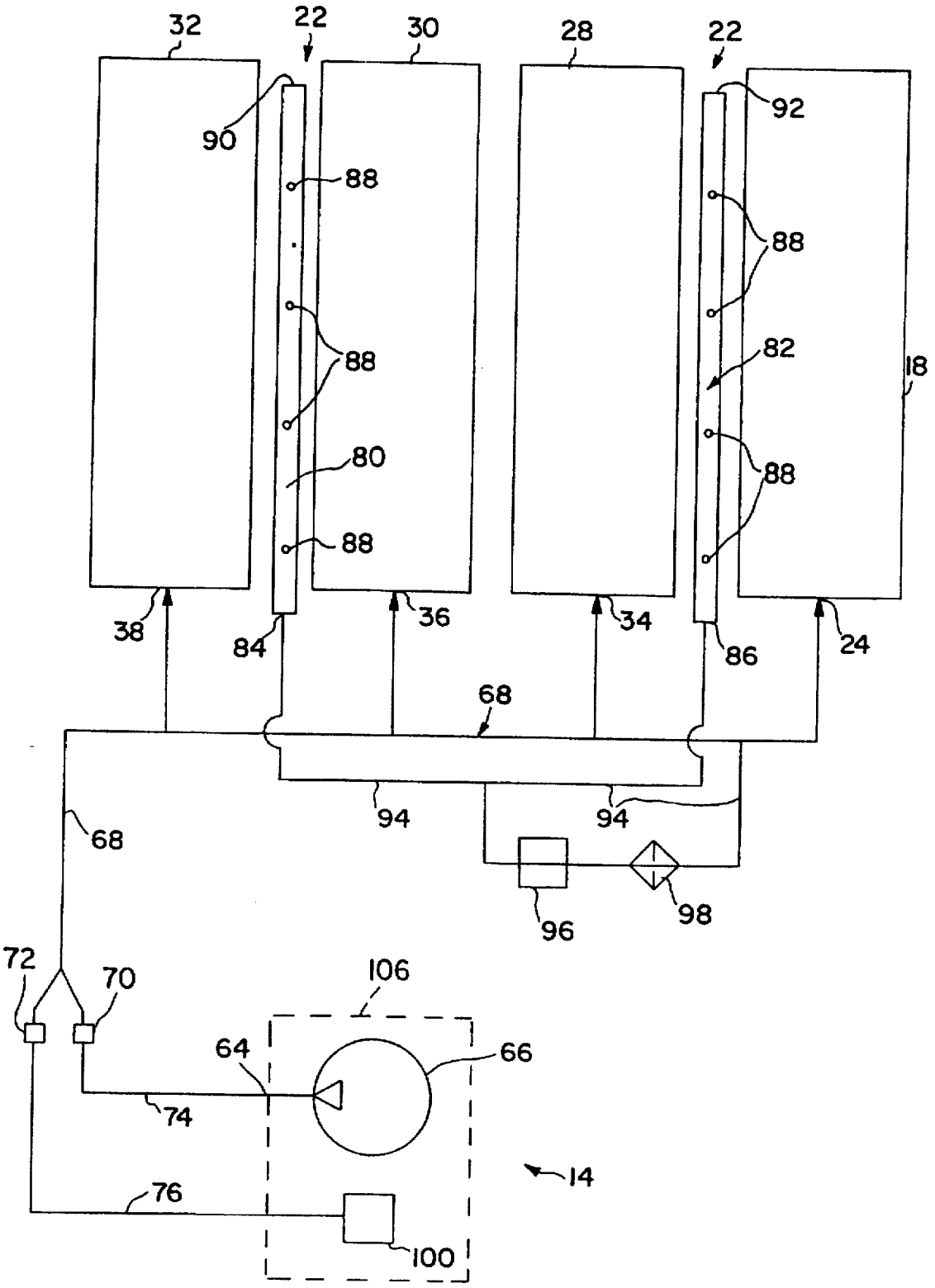
FIG. 4 is a diagrammatical view representing both device (or system) and methodology exemplary embodiments of the subject invention.

FIG. 4 is a diagrammatic representation of the air bladder and air tubing features of present FIGS. 1 through 3, combined with a diagrammatic representation of the overflow pressure manifold means generally 22, and the constant air flow pump means, generally 14.

Collectively referring to the Figures, a mattress body generally 12 includes preferably at least one patient air support bladder 18 having a bladder air input port 24. Such bladder 18 is preferably protected and supported in a stabilized position relative to mattress body 12 and other elements of the present invention, by a jacket or envelope, generally 26, which may be provided for such purpose. It should be understood that the visible portion of bladder 18 in FIG. 1 is actually the outer surface of such jacket arrangement 26.

In a preferred embodiment, and as further evident from the present Figures, preferably a total of four air support bladders, 18, 28, 30, and 32 are provided. While different numbers of such air bladders, and different sizes thereof may be practiced, preferably each bladder is formed of a flexible plastic tubing, or similar materials, and provided with a respective bladder air input port, 24, 34, 36, and 38. Each bladder may also be received in a respective sleeve or opening 40, 42, 44, and 46 of jacket 26. With such an arrangement, an elongated generally cylindrical construction of each respective air bladder is preferred. In other embodiments, transverse, diagonal, or other bladder positions may be practiced.

As further represented, the mattress body 12 may be provided with various foam support elements, generally 48, which may comprise different foam support sections having preselected combined characteristics of density, thickness, and indentation load deflection. Still further, certain of such foam sections, such as exemplary section 50, may include a plurality of surface cuts generally 52 forming generally circular channels 54 at the bottom thereof for defining air passageways for improved cooling and drying effects from air movement therethrough.

The collective assembly of such a mattress body may be provided with a generally air permeable cover 56. Such cover may have generally upper and lower sections 58 and 60, respectively, joined by a zippered arrangement 62, or other forms of closure means. Still further, such air permeable cover 56 may be generally water resistant.

Still referring collectively to the Figures, it may be observed that air supply pump means generally 14 has a pump air supply output port generally 64, at which pump 66 outputs a predetermined positive flow of air. As further represented, a first air tube generally 68 interconnects the pump air supply output port 64 with each of the bladder air input ports 24, 34, 36, and 38. In such fashion, the predetermined positive flow of air from pump 66 is supplied to the four exemplary patient air support bladders 18, 28, 30, and 32, respectively.

Such air tube 68, and other air tubes generally in this embodiment, may comprise, for example, plastic tubing with one quarter inch inside diameter. As represented in both FIGS. 1 and 4, such tubing may interconnect between the exterior and interior of mattress body 12 via simple pneumatic outlets or couplers (i.e., fittings) generally 70 and 72. Such devices may comprise couplers which readily connect and disconnect, and form a pneumatic seal, for quick set up of the mattress system 10. In general, air tubing 74 (FIG. 4) may comprise a pump output line operative with first air tube 68, while tube 76 may comprise a pump return line, also generally operable with first air tube 68, as discussed below. As represented in present FIG. 1, separate air lines 74 and 76 may be protectively bound in a single casing or sheath 78.

The mattress system generally 10 preferably may include at least one air distribution manifold 80 received within the mattress body 12. In the presently illustrated preferred embodiment, a second such manifold 82 is likewise received. Each such manifold 80 and 82 has a respective manifold air input port 84 and 86. With such arrangement, air received via the manifold air input port 84 or 86 is dispersed via low air loss holes 88 spaced along the length of the respective manifolds 80 and 82.

Such manifolds 80 and 82 may take various forms and constructions. One exemplary construction is that of an elongated vinyl tube, approximately 46 inches long, and with a one quarter inch inside diameter. Four holes, equally spaced at 12 inches from the next adjacent low air loss hole 88, may be formed by simply drilling through one peripheral area of the manifold tubing. Preferably, the tubing is oriented so that the low air loss holes 88 face upwardly towards surface 16, to facilitate dispersion of air from the mattress system. The distal ends 90 and 92 of the respective tubes 80 and 82 may simply be sealed with a plug and appropriate pneumatic sealing glue materials or the like.

With the foregoing arrangement, a low air loss manifold system generally 22 is provided. As understood by those of ordinary skill in the art, the embedded manifolds "bleed" air from their low air loss holes 88, which air may eventually pass through or around the porous foam pieces 48, and through the air permeable cover 56 (or openings designed therein if such cover is not generally air permeable), so as to provide desired cooling and drying effects on a patient received on upper surface 16 of mattress body 12.

In accordance with further aspects of this invention, a second air tube generally 94 interconnects in parallel with the first air tube, generally 68, and also interconnects with the respective manifold air input ports 84 and 86. A first pressure relief valve generally 96 functions as a regulator and is operatively received in-line of the second air tube 94. Spring actuated pressure relief valves are generally well known, and details of such form no particular aspect of the subject invention. Accordingly, any acceptable pressure relief valve may be practiced.

Pressure relief valves in the context of this invention comprise generally passive forms of control, in that they require no positive external input or any sensory feedback control in order to operate. Such first pressure relief valve generally 96 preferably has a set point established such that overflow pressure from the patient air support bladders 18, 28, 30, or 32 is ultimately dispersed within the mattress body 12 as low air loss via manifolds 80 and 82. An established set point generally in a range of from about 6 inches to about 10 inches of water, pressure relative to ambient atmospheric pressure, may be practiced. In the presently illustrated exemplary embodiment, a range of from about 8 inches to about 10 inches of water, pressure relative to ambient atmospheric pressure, is preferred.

As further represented in the Figures, an air flow restrictor generally 98 may be situated in the second air tube 94 upstream from the first pressure relief valve 96. A generally passive restrictor, such as an orifice plate may be used. It has been determined that adding such a restrictor in the second air path 94 helps keep the pressure level adequate in the first air path 68 for purposes of achieving pressure control in accordance with the subject invention. Per the present invention (both apparatus and methodology), regulator or pressure relief valve 96 is preferably fixed, to the preselected set point. With the collective arrangement presented herewith, such set point becomes the lowest pressure level down to which the air bladders 18, 28, 30, and 32 may "bleed" via manifolds 80 and 82. In other words, pressures greater than the lowest set point constitute overflow pressures from such air bladders, which is vented or exhausted in the form of low air loss via holes 88, as discussed above.

A second regulator or pressure relief valve generally 100 may be provided, for example, with a respective variable second set point for controllably establishing the operative pressure characteristics of the air supply pump means generally 14. As represented for example in present FIG. 4, the pump return line 76 may be parallel with the second air tube 94, and in line with the first air tube 68, for returning to said air supply pump means generally 14. The second pressure relief valve 100 vents to ambient atmosphere excess pressures generated by pump 66. The preferred second set point of the second pressure relief valve generally 100 is relatively higher than the set point established for the first pressure relief valve 96. Such an arrangement permits the system characteristics to be collectively determined by the two set points 96 and 100, also together with the functional pump characteristics of pump 66.

The air supply pump means generally 14 may preferably comprise an electrically operated pump having a generally constant output. It preferably operates continuously during patient use of the mattress system (by selection for example of a simple on/off switch 102), so as to provide a generally constant air flow rate, such as in a preferred range generally of from about 5 liters to about 9 liters per minute. In the presently illustrated exemplary embodiment, a pump flow rate set to be constant at generally about 7 liters per minute is preferred. Variations of features may be practiced. For example, device 104 may represent a knob for variably setting a constant air flow rate or may represent a meter for measuring the air flow being produced.

One example of a commercially available device generally 106 which may be utilized is the model HM-90 pump available from Huntleigh Healthcare, Inc., of Manalapan, N.J. Such particular pump has adequate capacities, as referenced above. It also has a built-in regulator, which may be reworked relative to a pump return line 76 so as to serve as the pressure relief valve 100. Those of ordinary skill in the art will appreciate that different pumps, and arrangements thereof, may be practiced in accordance with the broader aspects of the subject invention. Likewise, pump 66 and pressure relief valve 100 need not be, for example, housed within a single device 106, but may be separated from one another, and could be operatively interconnected with separate lines 74 and 76 not collectively protected in a jacket 78. All such variations are intended to come within the spirit and scope of the subject invention.

Other variations may be practiced. For example, the first and second air tubes may comprise different forms of plastic tubing (or tubing of other materials), having various inside diameters, such as generally in a range of from about ⅛ of an inch to about 1 inch. Different size mattresses, or even different applications, such as geriatric chairs, ambulance gurneys, or other embodiments may be practiced in accordance with this invention.

Still further, it is to be understood that the subject invention fully encompasses corresponding methodologies in accordance with practice of subject invention. One such methodology relates to a pressure relief valve vent line mattress. In accordance with such method, a mattress body generally 12 is provided including at least one patient air support bladder, such as 18, having a bladder air input port 24. In accordance with the method, a predetermined positive flow of air is provided to the patient air support bladder 18 via a first air tube 68 interconnected with said port 24 thereof.

Further provided is at least one air distribution manifold, such as 80 or 82, preferably received within the mattress body 12 and having a manifold air input port 84 or 86 for receiving and dispersing air supplied thereto. Still further in accordance with such methodology, overflow pressure is routed from the patient air support bladder to the manifold so as to disperse such overflow pressure within the mattress body as low air loss. A second air tube 94 is used to route such overflow pressure through a first pressure relief valve 96 having an established set point. With practice of such methodology, low air loss for patient cooling and drying effects are provided while the pressure level within the patient air support bladder is automatically controlled by venting such bladder overflow pressure via the manifold.

Other aspects of the invention as described above likewise apply to such methodology, and other corresponding methodologies.

It should also be understood that various pneumatic interconnections are well known to those of ordinary skill in the art, without discussing detailed constructions thereof. Variations thereof may be practiced, other than those represented in the present Figures, without departing from the spirit and scope of this invention.

In general, with practice of the invention, a beneficial positive air flow is obtained into the four (exemplary number) of air bladders, while the pressure relief valve arrangement "dumps" overflow pressure into the manifold to bleed out through the cover to reduce local ambient temperature relative to a patient and to achieve beneficial drying. Hence, beneficial skin conditioning (cooling and drying) is provided while a single air source is utilized so as to combine in a single step a pressure control operation with a low air loss feature. All alternative arrangements of the basic features and components disclosed herewith, for achieving functions and purposes set forth within the present claims are intended to come within the spirit and scope of the combined self-adjusting pressure relief and low air loss features herewith. For example, a mattress system or other device could be formed with a fewer or greater number of air bladders, oriented transversely or otherwise.

It should be further understood by those of ordinary skill in the art that the foregoing presently preferred embodiments are exemplary only and that the attendant description thereof is likewise byway of words of example rather than words of limitation and their use does not preclude inclusion of such modifications, variations, and/or additions to the present invention, as would be readily apparent to one of ordinary skill in the art, the scope of the present invention being set forth in the appended claims.

What is claimed is:

1. A pressure relief valve vent line mattress system, comprising:

a mattress body including at least one patient air support bladder having a bladder air input port;

air supply pump means, with a pump air supply output port, for outputting a predetermined positive flow of air at said pump air supply output port thereof;

a first air tube interconnecting said pump air supply output port with said bladder air input port so that said predetermined positive flow of air is supplied to said patient air support bladder;

at least one air distribution manifold received within said mattress body and having a manifold air input port for receiving and dispersing air supplied thereto;

a second air tube interconnecting with said first air tube in parallel therewith and interconnecting with said manifold air input port; and a first pressure relief valve operatively received in said second air tube, having a set point established such that overflow pressure from said patient air support bladder is dispersed within said mattress body as low air loss via said manifold for patient cooling and drying effects while the pressure level within said patient air support bladder is automatically controlled by venting via said manifold such bladder overflow pressure.

2. A mattress system as in claim 1, wherein:

said patient air support bladder is generally elongated and cylindrical in shape; and said air supply pump means comprises an electrically operated pump having a generally constant output.

3. A mattress system as in claim 2, further including:

a plurality of said air support bladders each having a respective bladder air input port, with all of said bladder air input ports being connected in parallel via said first air tube to said pump air supply output port; and further including an air flow restrictor situated in said second air tube upstream from said first pressure relief valve operatively received in said second air tube.

4. A mattress system as in claim 3, wherein said air supply pump means operates continuously during patient use of said mattress system, so as to provide a generally constant air flow rate in a range generally of from about 5 liters to about 9 liters per minute; and wherein said first pressure relief valve set point is established generally in a range of from about 6 inches to about 12 inches of water, pressure relative to ambient atmospheric pressure.

5. A mattress system as in claim 4, wherein said pump flow rate is set to be constant at generally about 7 liters per minute, and said first pressure relief valve set point is established in a range of from about 8 inches to about 10 inches of water, pressure relative to ambient atmospheric pressure.

6. A mattress system as in claim 4, further including a pump return line parallel with said second air tube, returning to said air supply pump means and having therein a second pressure relief valve with a respective second set point for controllably establishing the operative pressure characteristics of said air supply pump means, and wherein said second set point of said second pressure relief valve is generally higher than said first pressure relief valve set point.

7. A mattress system as in claim 4, further including a second air distribution manifold, with both manifolds comprising a respective length of flexible tubing with low air loss holes spaced therealong for dispersing air supplied to one respective end of each manifold.

8. A mattress system as in claim 4, wherein:

said first and second air tubes comprise plastic tubing having an inside diameter generally in a range of from about ⅛ inch to about 1 inch; and wherein said mattress body further includes foam support elements therein, collectively surrounded by an air permeable cover.

9. A mattress system as in claim 8, wherein said foam support elements comprise different foam support sections having preselected characteristics of density, thickness, and indentation load deflection, and wherein said foam support sections include a plurality of surface cuts forming generally circular channels at the bottom thereof for defining air passageways for cooling and drying effects from air movement therethrough; and wherein said air permeable cover is generally water resistant.

10. A methodology for a pressure relief valve vent line mattress, comprising:

providing a mattress body including at least one patient air support bladder having a bladder air input port;

applying via a first air tube a predetermined positive flow of air to said patient air support bladder via said port thereof;

providing at least one air distribution manifold received within said mattress body and having a manifold air input port for receiving and dispersing air supplied thereto; and routing overflow pressure from said patient air support bladder, via a second air tube through a first pressure relief valve having an established set point, to said manifold so as to disperse such overflow pressure within said mattress body as low air loss for patient cooling and drying effects while the pressure level within said patient air support bladder is automatically controlled by venting such bladder overflow pressure via said manifold.

11. A methodology as in claim 10, wherein:

said air support bladder is generally elongated and cylindrical in shape; and wherein said predetermined positive flow of air is a generally constant output of air to said patient air support bladder.

12. A methodology as in claim 11, further including:

providing a plurality of said air support bladders each having a respective bladder air input port, and applying via the first air tube said predetermined generally constant flow of air to all of said bladder air input ports; and further including the step of at least partially restricting the flow of air within the second air tube upstream from said first pressure relief valve associated therewith.

13. A methodology as in claim 12, further including:

providing said predetermined positive flow of air continuously during patient use of the mattress, so as to provide a generally constant air flow rate in a range generally of from about 5 liters to about 9 liters per minute; and wherein the first pressure relief valve set point is established generally in a range of from about 6 inches to about 12 inches of water, pressure relative to ambient atmospheric pressure.

14. A methodology as in claim 13, including:

establishing said generally constant air flow rate to be generally about 7 liters per minute; and establishing the first pressure relief valve set point in a range of from about 8 inches to about 10 inches of water, pressure relative to ambient atmospheric pressure.

15. A methodology as in claim 13, further including providing a return air line parallel with the second air tube, returning to a source of air supply, and having therein a second pressure relief valve with a respective second set point for controllably establishing an operative pressure characteristic of an air supply source, with such second set point of the second pressure relief valve being set generally higher than the first pressure relief valve set point.

16. A methodology as in claim 13, further including providing a second air distribution manifold, with both manifolds comprising a respective length of flexible tubing with low air loss holes spaced therealong for dispersing air supplied to one respective end of each manifold.

17. A methodology as in claim 13, further including:

providing said mattress body with foam support elements therein, collectively surrounded by an air permeable cover, with said foam support elements comprising different foam support sections having preselected characteristics of density, thickness, and indentation load deflection, and wherein such foam support sections include a plurality of surface cuts forming generally circular channels at the bottom thereof for defining air passageways for cooling and drying effects from air movement therethrough; and wherein the air permeable cover is generally water resistant.

18. A self-adjusting pressure relief patient support apparatus with low air loss function, comprising:

a main support body for receiving a patient thereon, and having at least one adjustable air support bladder with air therein;

constant air flow pump means, in pneumatic communication with said air support bladder, for automatically supplying said bladder a generally constant predetermined air flow regardless of changing patient loading on said main support body; and overflow pressure manifold means, operatively associated with said air support bladder for dispersing overflow pressure air therefrom through said main support body as a low air loss, so that bladder air pressure is automatically controlled as patient cooling and drying effects are provided with the low air loss derived from such overflow pressure.

19. A patient support apparatus as in claim 18, wherein said overflow pressure manifold means includes a regulator for dispersing overflow pressure in a range of from about 6 inches to 12 inches of water, pressure relative to ambient atmospheric pressure.

20. A patient support apparatus as in claim 19, wherein said regulator comprises a pressure relief valve with a set point generally established in a range of from about 8 inches to about 10 inches of water, pressure relative to ambient atmospheric pressure.

21. A patient support apparatus as in claim 20, further including an orifice restrictor situated upstream from said pressure relief valve.

22. A patient support apparatus as in claim 18, wherein:

said main support body includes a plurality of air support bladders; and said constant air flow pump means includes a pressure relief valve associated with the air flow thereof for regulating such air flow.

23. A patient support apparatus as in claim 22, wherein:

said main support body includes foam support sections having a plurality of defined cuts for air transmission; and said generally constant predetermined air flow is in a range of from about 5 liters per minute to about 9 liters per minute.

24. An air bladder mattress system providing automatic air pressure equalization combined with low air loss function achieved from a single air flow source, said system comprising:

a main patient support mattress having respective foam and air bladder support elements, including a plurality of air bladders each of which have respective bladder air input ports;

an air flow pump having a generally constant air flow output;

a first section of air tubing directing said pump air flow output commonly into said respective bladder air input ports;

at least one bleeder tube residing within said main patient support mattress, and having a plurality of low air loss holes formed therealong so that air fed to one end of such bleeder tube is dispersed within said mattress via said tube holes; and a second section of air tubing and a pressure relief valve with a predetermined set point, collectively forming a vent line between said first section of air tubing and said bleeder tube, so that air pressure within said plurality of air bladders greater than that of said predetermined set point is dispersed via the low air loss holes so as to automatically control such bladder air pressure while providing patient cooling and drying effects, thereby utilizing said air flow pump as a single source of air flow for operating both such functions.

25. An air bladder mattress system as in claim 24, wherein:

said second section of air tubing further includes a flow restrictor upstream from said pressure relief valve; and said mattress system further includes a pump return section of air tubing situated in parallel with said first section of air tubing, and having a regulator operative as a pressure relief valve having a set point value higher than that of said pressure relief valve predetermined set point.

26. An air bladder mattress system as in claim 24, wherein:

said foam support elements include a plurality of respective support sections, at least one of which has an upper support surface segmented by generally circular bottom cross-section air channels for propagating air communication; and wherein said generally constant air flow output is in a range of from about 5 liters to about 9 liters per minute, and said predetermined set point is in a range of from about 6 inches to about 12 inches of water, pressure relative to ambient atmospheric pressure.

* * * * *